US005822793A

United States Patent [19]

Tokura et al.

[11] Patent Number: 5,822,793

[45] Date of Patent: Oct. 20, 1998

[54] CLOTHING CAPABLE OF EXPOSING INSIDE THEREOF

[75] Inventors: Shigeko Tokura, Kurashiki; Kumiko Tanaka, Mino, both of Japan

[73] Assignee: Jumbo Tokura Co. Ltd., Okayama, Japan

[21] Appl. No.: 787,567

[22] Filed: Jan. 22, 1997

[51] Int. Cl.[6] ..... A41B 9/00

[52] U.S. Cl. ..... 2/69; 2/79; 2/80; 2/227; 2/78.2; 2/83

[58] Field of Search ..... 2/70, 79, 80, 69, 2/227, 83, 228, 238, 78.2, 234

[56] References Cited

U.S. PATENT DOCUMENTS

| | | | |
|---|---|---|---|
| Re. 26,360 | 3/1968 | Pagano | 2/227 |
| 1,854,262 | 4/1932 | Johannesen . | |
| 1,945,747 | 2/1934 | Martin | 2/70 |
| 1,973,421 | 9/1934 | Wallace | 2/80 |
| 2,228,624 | 1/1941 | Frank | 2/79 |
| 2,507,382 | 5/1950 | Norvich | 2/80 |
| 2,570,428 | 10/1951 | Clifford | 2/80 |
| 2,738,512 | 3/1956 | Winer | 2/80 |
| 3,555,567 | 1/1971 | Owen | 2/80 |
| 3,789,429 | 2/1974 | Garcia | 2/79 |
| 4,457,025 | 7/1984 | Meryash . | |
| 4,773,101 | 9/1988 | Kapp et al. | 2/80 |
| 5,008,962 | 4/1991 | Smith et al. | 2/79 |

FOREIGN PATENT DOCUMENTS

| | | |
|---|---|---|
| 70.22501 | 1/1972 | France . |
| 674299 A5 | 5/1990 | Switzerland . |
| 407445 | 9/1933 | United Kingdom . |

*Primary Examiner*—Gloria Hale

*Attorney, Agent, or Firm*—Michael D. Bednarek; Kilpatrick Stockton LLP

[57] ABSTRACT

A piece of clothing includes an upper envelope portion, two leg portions extending downward from the envelope portion and separated from each other at a crotch, and a flap portion. The flap portion is formed by two elongate cuts each of which extends from the envelope portion into a respective one of the leg portions. The flap portion is engageable with the envelope portion via an engaging device but disengageable therefrom for hinging around the crotch to open the crotch.

9 Claims, 4 Drawing Sheets

CLOTHING CAPABLE OF EXPOSING INSIDE THEREOF

BACKGROUND OF THE INVENTION

1. Field of the Invention:

The present invention relates to a piece of clothing that is capable of exposing the inside thereof for changing diapers or going to stool.

2. Description of the Related Art:

Conventional rompers, overalls and the like consist of trousers and a top that are joined together. As a consequence, these clothes must be almost entirely removed for changing diapers or going to stool, for example. This is inconvenient. Similarly, with conventional trousers, when the wearer of the trousers is a very old or sick person who must wear a diaper since he cannot go to stool by himself, the trousers have to be taken off for changing diapers. In addition to the inconvenience, it can be a very uncomfortable experience to take off these clothes especially in cold weather.

SUMMARY OF THE INVENTION

It is, therefore, an object of the present invention to provide a piece of clothing that is capable of easily exposing the inside thereof without taking off the clothing for changing diapers or going to stool.

According to the present invention, there is provided a piece of clothing comprising: an upper envelope portion; two leg portions extending downward from the envelope portion and separated from each other at a crotch; and a flap portion formed by two elongate cuts each extending from the envelope portion into a respective one of the leg portions. The flap portion is engageable with the envelope portion via an engaging device but disengageable therefrom for hinging around the crotch to open the crotch.

With such an arrangement, changing diapers or relieving oneself (going to stool) is advantageously performed without taking off the clothing since the inside of the clothing is exposed simply by opening the flap portion.

Other objects, features and advantages of the present invention will be clear from the detailed explanation of the preferred embodiments described below with reference to the accompanying drawings.

DETAILED DESCRIPTION OF THE PREFERRED EMBODIMENTS

Figure 1:
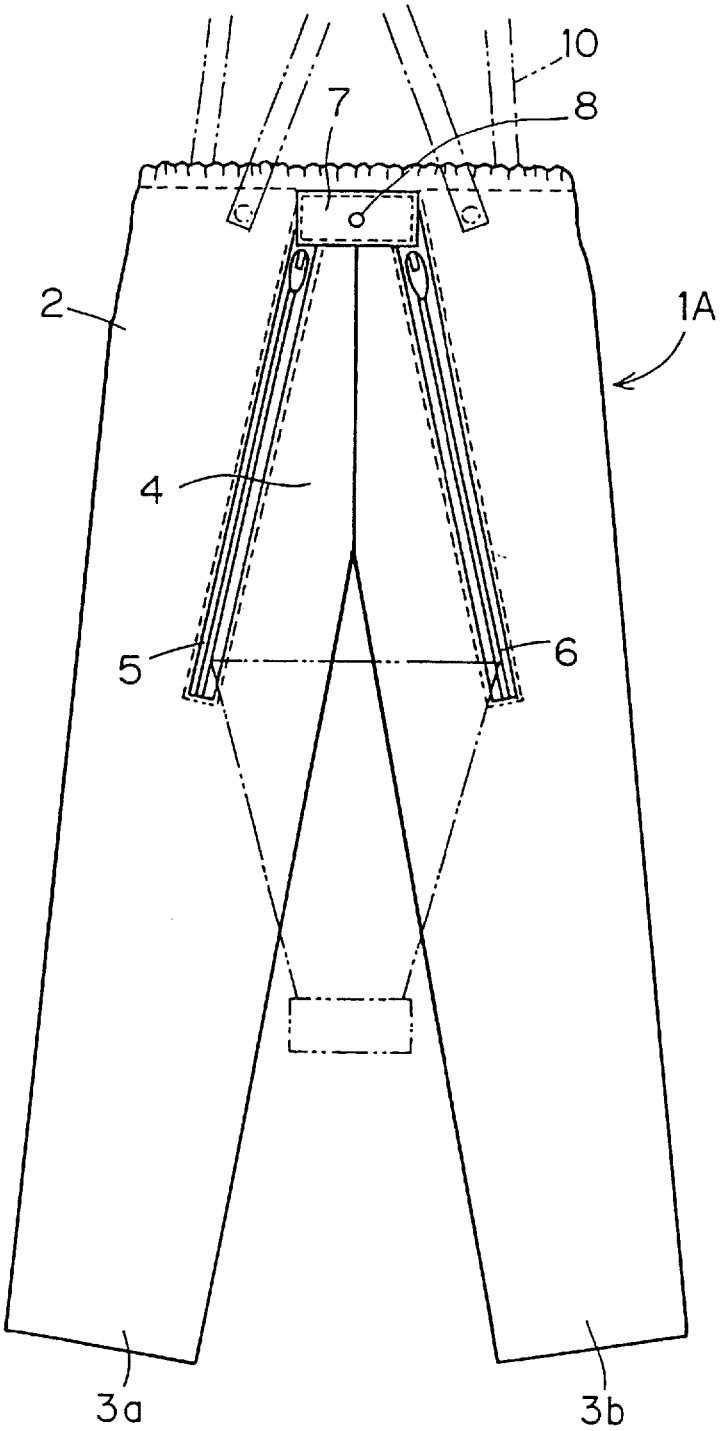
FIG. 1 is a rear view of trousers.
Figure 2:
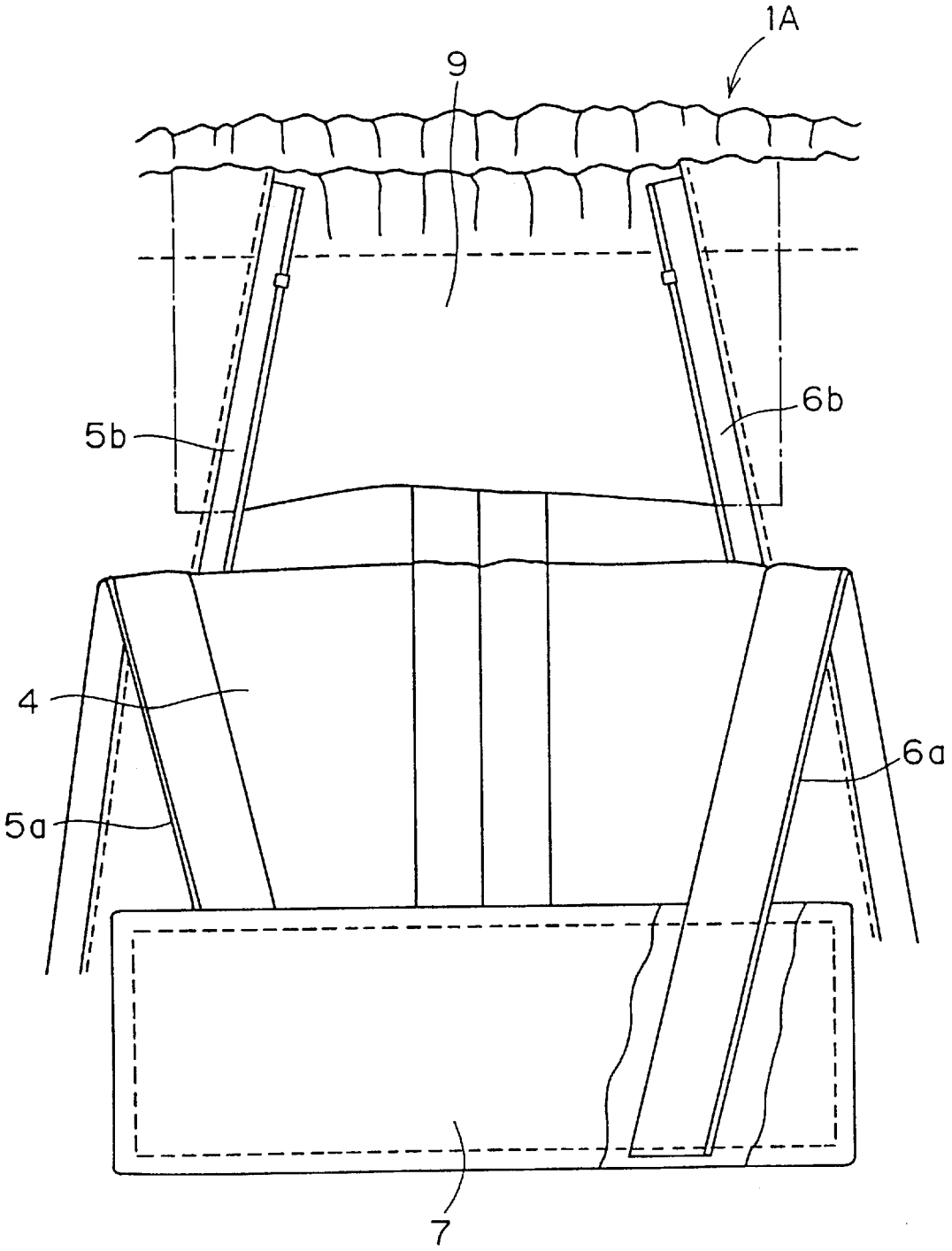
FIG. 2 is an enlarged rear view of principal parts, in which a flap portion is folded back.

FIGS. 1 and 2 illustrate a rear view of trousers 1A according to a first embodiment of the present invention. The trousers 1A may be advantageously used by sick or aged people who need to wear a diaper but cannot dispose of excreta by themselves. The trousers 1A may be designed so that diapers can be changed even when the wearer of the trousers is kept standing.

Referring to FIG. 1, the trousers 1A include an upper envelope portion 2 and a pair of leg portions 3*a*, 3*b*. Further, the trousers 1A also include a flap portion 4 provided at the rear side thereof. The flap portion 4 is designed to come into releasable engagement with the upper envelope portion 2 via slide fasteners 5, 6, such as zippers for example. Thus, the inside of the trousers (or the buttocks of the wearer) can be advantageously exposed by undoing the fasteners 5, 6 to release engagement between the flap portion 4 and the upper envelope portion 2 (and the leg portions).

The flap portion 4 is formed by a pair of elongate cuts that define side edges of the flap portion 4. The cuts extend from the top edge of the trousers 1A (thus, the top edge is disconnected in this stage) into the respective leg portions 3*a*, 3*b*, in a manner such that the distance between the cuts become larger downward (see FIG. 1). As shown in FIG. 2, the slide fastener 5 includes a first fastening member 5*a* and a second fastening member 5*b*, while the slide fastener 6 includes a first fastening member 6*a* and a second fastening member 6*b*. The first fastening members 5*a*, 6*a* are sewn to the flap portion 4 along the side edges thereof, while the second fastening members 5*b*, 6*b* are sewn to the upper envelope portion 2 along the side edges which are also defined by the elongate cuts. In this embodiment, the lower ends of the elongate cuts are located above but near to the respective knees of the trousers 1A. Thus, the lower ends of the fasteners 5, 6 are also located above, but near to the knees.

As shown in FIG. 1, the upper end (or the free end) of the flap portion 4 is provided with a holding member 7 sewn thereto. The holding member 7 projects horizontally beyond the flap portion 4 (see also FIG. 2). In the illustrated embodiment, the upper ends of the first fastening members 5*a*, 6*a* together with the holding member 7 are sewn to the flap portion 4, thereby providing greater fixing strength while also facilitating production. The holding member 7 serves to provide a neater appearance to the trousers 1A and maintain the shape of the trousers, while also facilitating the handling of the flap portion 4 when undoing the fasteners 5, 6.

Figure 1A:
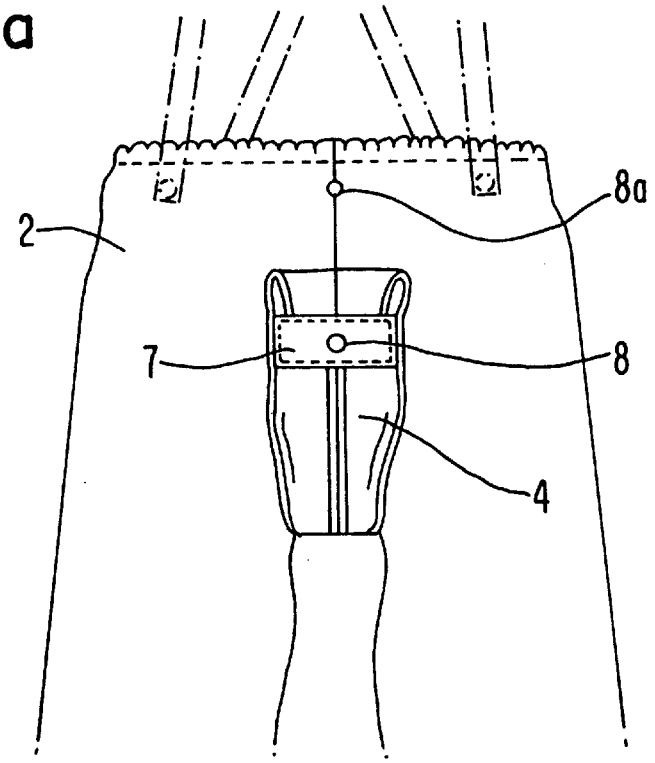
FIG. 1*a* is a front view of the same trousers with the flap portion partially extended.
Figure 1B:
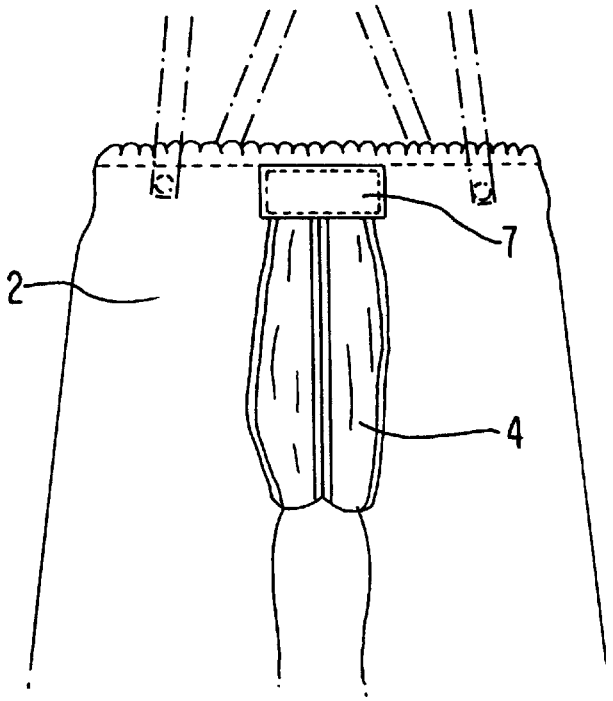
Fig. 1*b* is a front view of the same trousers with the flap portion fully extended.

The holding member 7 may be provided with a first snap member 8 which can be brought into engagement with a second snap member 8*a* (see FIG. 1*a*). The second snap member 8*a* may be fixed to the front side of the trousers at a suitable portion thereof. In this arrangement, when the flap portion 4 is folded back as shown by the phantom lines in FIG. 1, and brought forward under the crotch of the trousers 1A, and then raised (hinging movement around the crotch) as shown in FIG. 1*a*, the first and second snap members 8, 8*a* can be advantageously brought into engagement with each other, thereby keeping the inside of the trousers 1A (or the buttocks of the wearer) exposed without manually holding the flap portion 4. Instead of the snap members, some buttons, Velcro tape and the like may be used for engagement of the holding member 7. Further, even without using any of these items, the same purpose may be fulfilled by simply tucking the free end (the upper end) of the flap portion 4 into the trousers 1A.

As shown in FIG. 2, an elastic connector 9 is sewn to the body 4 to connect the above-mentioned disconnected upper edge of the trousers 1A. With such an arrangement, the inside of the trousers 1A can be exposed to a great extent. The connector 9 may also serve to keep the shape of the trousers 1A. In the illustrated embodiment, the second fastening members 5*a*, 6*b* are sewn to the upper envelope portion 2 together with the connector 9, thereby advantageously providing increased fixing strength.

It is also possible to form the flap portion 4 by providing a horizontal cut below the top edge of the trousers 1A and two elongate cuts extending from the respective ends of the horizontal cut into the leg portions 3*a*, 3*b*.

In the illustrated embodiment, without using a non-elastic belt, an elastic rubber string is inserted through the upper edge of the trousers 1A to allow the trousers to be easily put on or taken off. Further, in the embodiment, suspenders 10 are used to prevent the trousers 1A from dragging down. However, depending on the condition of the wearer, a non-elastic leather belt may be used, or the suspenders 10 may be dispensed with.

In an instance of an old person wearing a diaper, it is advantageous to use a suspending device (not shown) that is connected to inner sides of the trousers so that the front side of the diaper is prevented from dragging down. Thus, in disposing of feces, the rear side of the diaper may firstly be advantageously taken care of. The suspending device may comprise a string and two clips connected to both ends of the string.

The holding member 7 and the engaging member 8 may take any form, such as a triangle, an oval, a circle and the like.

Figure 3:
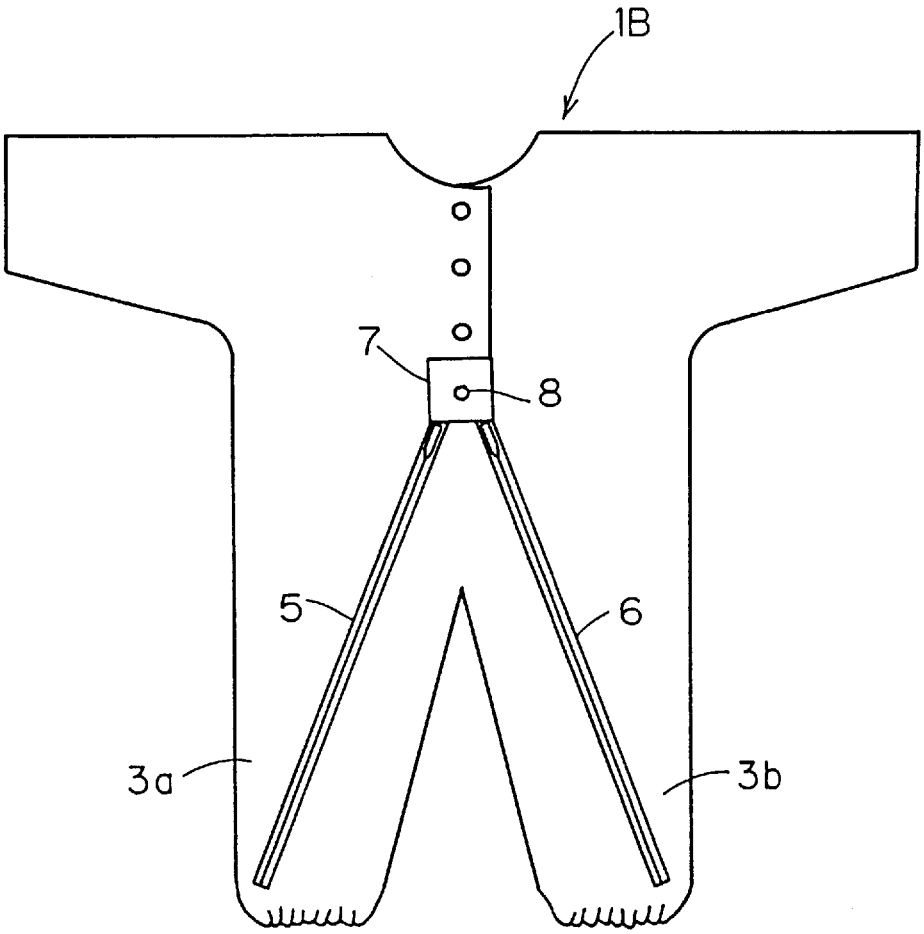
FIG. 3 is a front view of rompers.

FIG. 3 shows rompers 1B as another embodiment of the present invention. In this embodiment, the flap portion 4 is provided at the front side of the rompers. The slide fasteners 5, 6 are designed to extend close to the lower ends of the respective leg portions 3*a*, 3*b*. This allows the flap portion 4 to be opened wide so that diapers may be changed easily even when the wearer is kept standing.

In this embodiment, the flap portion 4 is defined by a horizontal cut formed at a position corresponding to the navel of the wearer and two elongate cuts extending from the respective ends of the horizontal cut toward the lower ends of the leg portions 3*a*, 3*b*. Similarly to the previous embodiment, a holding member and a connector (not shown) are sewn to proper portions. In such rompers for babies, it is preferred that each of the elongate cuts extending toward the leg portions 3*a*, 3*b* are formed to curve outward at the position of the knee of the rompers 1B for avoiding the knee position. Thus, the flap portion 4 can be advantageously opened to a great extent, while the baby is prevented from suffering an uncomfortable experience by contact of the slide fasteners 5, 6 with his knees. As with the previous embodiment, the holding member 7 may be provided with a first snap member 7 for engagement with a second snap member (not shown) provided on the rear side of the rompers 1B.

Similarly to the embodiment shown in FIG. 3, but in connection with overalls for an adult, it is also possible to form a flap portion 4 at the front side of the overalls so that the wearer can relieve himself without taking off the overalls. In overalls, however, each of the cuts extending toward the leg portions extends only to a position above but near to the knee of the leg portion like the embodiment shown in FIG. 1. A holding member 7 and a connector 9 may also be provided.

The preferred embodiments of the present invention being thus described, it is obvious that the same may be varied in many ways. such variations are not to be regarded as a departure from the spirit and the scope of the present invention, and all such modifications as would be obvious to those skilled in the art are intended to be included within the scope of the following claims.

We claim:

1. A piece of clothing comprising:

an upper envelope portion;

two leg portions extending downward from the envelope portion and separated from each other at a crotch; and a flap portion formed by two elongate cuts each extending from the envelope portion into a respective one of the leg portions, the flap portion being movable to a first position for closing the crotch, the flap portion being also movable to a second position for opening the crotch;

a first fastening device for holding the flap portion in said first position;

a second fastening device for holding the flap portion in said second position.

2. The piece of clothing according to claim 1, wherein the flap portion has a free end provided with a holding member for manual grabbing.

3. The piece of clothing according to claim 1, wherein the flap portion is provided with a rear side of the envelope portion.

4. The piece of clothing according to claim 1, wherein the flap portion is provided with a front side of the envelope portion.

5. The piece of clothing according to claim 1, wherein the second fastening device comprises a first snap member provided on the flap portion and a second snap member provided on the envelope portion.

6. The piece of clothing according to claim 1, wherein the flap portion has side edges defined by the elongate cuts, the first fastening device comprising a first engaging member fixed to each side edge of the flap portion and a second engaging member fixed to the envelope portion and each leg portion along each elongate cut.

7. The piece of clothing according to claim 6, wherein the first fastening device comprises a slide fastener.

8. The piece of clothing according to claim 6, further comprising a connector attached to the envelope portion for bridging between the two elongate cuts at respective upper ends thereof.

9. The piece of clothing according to claim 8, wherein the connector is also attached to the second engaging member of the first fastening device.

* * * * *